US007726381B2

(12) United States Patent
Taniguchi

(10) Patent No.: US 7,726,381 B2
(45) Date of Patent: Jun. 1, 2010

(54) CONTROL METHOD OF DIE-CASTING MACHINE

(75) Inventor: Yoshiya Taniguchi, Akashi (JP)

(73) Assignee: Toyo Machinery & Metal Co., Ltd., Akashi-shi (JP)

( * ) Notice: Subject to any disclaimer, the term of this patent is extended or adjusted under 35 U.S.C. 154(b) by 191 days.

(21) Appl. No.: 12/026,009

(22) Filed: Feb. 5, 2008

(65) Prior Publication Data

US 2008/0185119 A1 Aug. 7, 2008

(30) Foreign Application Priority Data

Feb. 5, 2007 (JP) ..... 2007-025487

(51) Int. Cl.
*B22D 17/10* (2006.01)
*B22D 17/32* (2006.01)

(52) U.S. Cl. ..... 164/113; 164/133; 164/312

(58) Field of Classification Search ..... 164/113, 164/312, 133, 136
See application file for complete search history.

(56) References Cited

U.S. PATENT DOCUMENTS 7,004,224 B2 * 2/2006 Tsuzuki et al. ..... 164/312
7,137,435 B2 * 11/2006 Fujikawa ..... 164/312

FOREIGN PATENT DOCUMENTS

| | | |
|---|---|---|
| CN | 1509829 A | 7/2004 |
| CN | 1638941 A | 7/2005 |
| JP | 01-197055 | 8/1989 |
| JP | 3247086 B2 | 11/2001 |

* cited by examiner

*Primary Examiner*—Kevin P Kerns
(74) *Attorney, Agent, or Firm*—Crowell & Moring LLP

(57) ABSTRACT

A die-casting machine using an electric servo motor as a driving source for injecting/filling molten metal into a cavity of a mold through an injection sleeve. The molten metal in the injection sleeve is injected/filled into the cavity by an injection member. During the course between the stage when the molten metal has not reached a gate of the mold yet and the stage when the molten metal begins to pass the gate of the mold, the speed of the injection member is controlled to be accelerated in a smooth speed characteristic curve which does not have a broken-line characteristic. Thus, rising to a high injection speed can be attained rapidly and smoothly.

9 Claims, 12 Drawing Sheets

PRIOR ART

PRIOR ART

CONTROL METHOD OF DIE-CASTING MACHINE

FIELD OF THE INVENTION

The present invention relates to a control method of a die-casting machine for injecting/filling molten metal into a mold, and particularly relates to a technique for controlling injection in a die-casting machine in which injection/filling is performed with an electric servo motor.

BACKGROUND OF THE INVENTION

A cold chamber type disc-casting machine in which a molten metal material is injected/filled into a cavity of a mold through an injection sleeve so as to obtain a product has been known well. In the die-casting machine, a metal material (for example, an Al alloy, an Mg alloy, etc.) melted in a melting furnace is measured and scoped by ladle every one shot. The scooped molten metal (molten metal material) is supplied into the injection sleeve. The supplied molten metal is injected/filled into the cavity of the mold by the forward movement of an injection plunger.

A process of casting with a die-casting machine generally includes an injection/filling step and a pressure intensifying step following the injection/filling step. The injection/filling step has a low-speed injection step and a high-speed injection step. A higher injection speed than that in plastic injection molding is required in the high-speed injection step. Generally in the background art, a hydraulic driving source has been used as a driving source for injection/pressure intensifying. Performance of rapid rising to a high speed is required in die-casting machines. When a small-size electric servo motor is used as a driving source for injection/pressure intensifying, the accelerating performance of the small-size electric servo motor cannot satisfy the required performance. However, when a large-size and high-power electric servo motor is used, the cost increases on a large scale.

However, hydraulic die-casting machines may cause a taint damage. Recently there is a growing demand for a clean electric die-casting machine. Such an electric die-casting machine is being developed. A die-casting machine disclosed in Japanese Patent No. 3247086 (Patent Document 1) is an example of a background-art die-casting machine using an electric servo motor as a driving source for injection/pressure intensifying. In the die-casting machine according to Patent Document 1, a fly-wheel unit for accumulating rotational energy is provided. The fly-wheel unit is driven to rotate by an injection electric servo motor before the operation of injection/pressure intensifying. Thus, the rotational energy is accumulated in the fly-wheel unit, and the power from the fly-wheel unit is supplied (added) to the driving power of the injection electric servo motor at an early stage of a high-speed injection step of an injection/filling step and at an early stage of a pressure intensifying step (pressure intensifying/holding step).

FIG. 11 is a chart showing the state of the injection/filling step and the pressure intensifying step (pressure intensifying/holding step) in the die-casting machine disclosed in Patent Document 1. In FIG. 11, the abscissa designates time, and the ordinate designates speed and pressure. As shown in FIG. 11, time of adding power from the fly-wheel unit is provided at an early stage of the high-speed injection step and at an early stage of the pressure intensifying step. Thus, the time of rising to a high injection speed is shortened, and the time of rising to intensified pressure is shortened.

In the background art, as shown in FIG. 11, the injection/filling step is definitely separated into a low-speed injection step and a high-speed injection step, and a speed in a boundary M between the low-speed injection step and the high-speed injection step is set as a broken-line characteristic. The boundary M (timing of termination of the low-speed injection step) between the low-speed injection step and the high-speed injection step corresponds to the timing when degassing has been completed and the head of molten metal has just reached a gate of a mold. The speed (injection plunger speed) is designed to rise rapidly on and after this timing.

Patent Document 1: Japanese Patent No. 3247086

In the background art, as described above, the injection/filling step is definitely separated into a low-speed injection step and a high-speed injection step, and the speed in the boundary M between the low-speed injection step and the high-speed injection step is set as a broken-line characteristic. In order to shorten the time of rising to a high injection speed, the technique disclosed in Patent Document 1 uses the rotational energy accumulated in the fly-wheel unit. However, an ON-OFF controllable clutch is required to use the rotational energy accumulated in the fly-wheel unit. Thus, the transient response in rising to the high speed is slowed by the time of ON operation of the clutch (the response delay time of the clutch). In addition, first of all, there is an obvious limit in improvement of the transient response of servo control because the speed is made to rise suddenly from a constant low speed to a high speed. That is, when the electric servo motor is controlled to be accelerated in the stage where molten metal begins to be injected/filled into the cavity of the mold, there is an obvious limit in shortening the time to reach the high speed. Further, the speed in the boundary M (the timing of termination of the low-speed injection step) between the low-speed injection step and the high-speed injection step is set at a value about 0.7 m/sec or lower in the background art. A specified time is required to rise from such a speed to a high speed.

Of die-casting machines using a hydraulic driving source as a driving source for injection/pressure intensifying, as shown in FIG. 12, there has been known a machine in which constant acceleration control is applied to a low-speed injection step of an injection/filling step by use of a hydraulic servo valve having a high-speed response so that the speed in the low-speed injection step can be increased gradually. Even in the control shown in FIG. 12, the speed in a boundary N between the low-speed injection step and a high-speed injection step is set as a broken-line characteristic. In addition, the boundary N (the timing of termination of the low-speed injection step) between the low-speed injection step and the high-speed injection step is set at a value about 0.7 m/sec or lower. Even in the hydraulic die-casting machine, it cannot be denied that there may be a problem similar to the aforementioned one though there is a difference in degrees.

SUMMARY OF THE INVENTION

The present invention was developed in consideration of the foregoing problems. An object of the present invention to provide a die-casting machine which rising to a high injection speed can be attained rapidly and smoothly in spite of using an electric servo motor as a driving source for injection/filling.

In order to attain the foregoing object, the present invention provides a control method of a die-casting machine for injecting/filling molten metal into a cavity of a mold through an injection sleeve, the control method including the step of:

controlling a speed of an injection member, by which the molten metal in the injection sleeve is injected/filled into the cavity, so as to accelerate the speed of the injection member in a smooth speed characteristic curve, which does not have a broken-line characteristic, during a course between a stage where the molten metal has not reached a gate of the mold yet and a stage where the molten metal begins to pass the gate of the mold.

An electric servo motor may be used as a driving source for injecting/filling the molten metal into the cavity of the mold through the injection sleeve.

The speed of the injection member at timing when the molten metal reaches the gate of the mold may be made not lower than 1.5 m/sec.

The injection member may be moved forward and backward by use of at least a crank mechanism driven by the electric servo motor, so that accelerating the electric servo motor is completed before the molten metal reaches the gate of the mold, and the injection member is accelerated in conformity with a speed ratio characteristic of the crank mechanism after the molten metal reaches the gate of the mold.

The present invention also provides a control method of a die-casting machine including an injection plunger moving forward and backward in an injection sleeve, a first electric servo motor and a second electric servo motor as driving sources for the injection plunger, a ball screw mechanism for converting a rotational force of the first electric servo motor into a linear motion to thereby drive the injection plunger linearly, and a crank mechanism for converting a rotational force of the second electric servo motor into a linear motion to thereby drive the injection plunger linearly, the injection plunger being driven linearly with cooperation of the first and second electric servo motors, the control method including the step of:

controlling a speed of the injection plunger by use of a speed ratio characteristic of the crank mechanism when the molten metal in the injection sleeve is injected/filled into a cavity of a mold, so as to accelerate the speed of the injection plunger in a smooth speed characteristic curve, which does not have a broken-line characteristic, during a course between a stage where the molten metal has not reached a gate of the mold yet and a stage where the molten metal begins to pass the gate of the mold.

The speed of the injection plunger at timing when the molten metal reaches the gate of the mold may be made not lower than 1.5 m/sec.

A force input terminal of the crank mechanism may be designed to be driven to rotate through a fly-wheel which is driven to rotate by the second electric servo motor, while controlling acceleration of the second electric servo motor is completed at timing when the molten meal reaches the gate of the mold.

The injection plunger may be accelerated in conformity with the speed ratio characteristic of the crank mechanism after the molten metal reaches the gate of the mold.

At least a rotational inertial force of the fly-wheel may be used for intensifying pressure at an early stage of a pressure intensifying step.

According to the present invention, in a die-casting machine using an electric servo motor as a driving source for injection/filling, the speed of the injection plunger for injecting/filling molten metal in the injection sleeve into a cavity of a mold is controlled to be accelerated in a smooth speed characteristic curve, which does not have a broken-line characteristic, during a course between a stage where the molten metal has not reached a gate of the mold yet and a stage where the molten metal begins to pass the gate of the mold. In addition, the speed of the injection plunger at timing when the molten metal reaches the gate of the mold is made not lower than 1.5 m/sec. Thus it is possible to shorten the time to reach a high speed which is, for example, 3.5 m/sec. It is also possible to make the acceleration behavior of the injection member smooth and moderate. Accordingly in spite of the configuration where the electric servo motor is used as a driving source for injection/filling, the operation of injecting/filling molten metal which will be cooled and solidified more quickly than synthetic resin can be controlled suitably enough to make a great contribution to casting a good product.

Further, the injection member is moved forward and backward by use of at least a crank mechanism driven by the electric servo motor, so that accelerating the electric servo motor is completed before the molten metal reaches the gate of the mold, and the injection member is accelerated in conformity with the speed ratio characteristic of the crank mechanism after the molten metal reaches the gate of the mold. Accordingly, accelerating the electric servo motor is completed at the timing when the molten metal reaches the gate of the mold (or the timing immediately before the molten metal begins to be injected/filled into the cavity of the mold). In comparison with the background art where the electric servo motor is controlled to be accelerated on and after the timing when the molten metal reaches the gate of the mold, there is no response delay due to the acceleration of the electric servo motor during the course where the molten metal is injected/filled into the cavity of the mold. Thus the time of injecting/filling the molten metal into the cavity of the mold can be made as short as possible.

BRIEF DESCRIPTION OF THE DRAWINGS

FIGS. 9A, 9B-1, 9B-2, 9C-1, 9C-2 and 9D are explanatory views showing degassing behavior according to the embodiment in comparison with degassing behavior in the background art;

DETAILED DESCRIPTION OF THE EMBODIMENT

An embodiment of the present invention will be described below with reference to the drawings.

Figure 1:
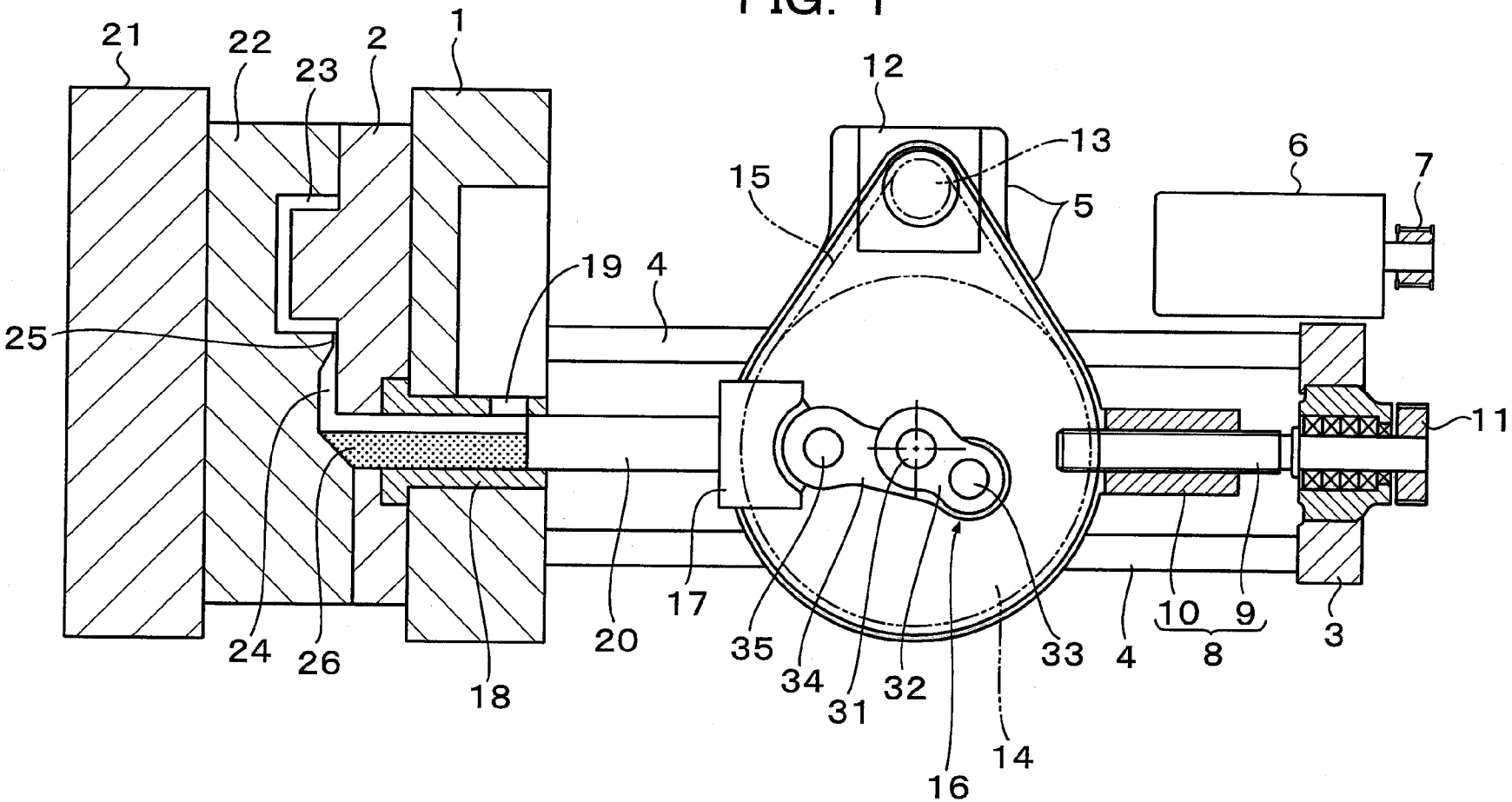
FIG. 1 is a simplified and partially cutaway explanatory view showing the main portion configuration of a die-casting machine according to an embodiment of the present invention, where the die-casting machine has not injected/filled yet.

FIGS. 1, 2 and 4-10 show an electric die-casting machine according to an embodiment (hereinafter referred to as "this embodiment") of the present invention. FIG. 1 is a simplified and partially cutaway explanatory view showing the main portion configuration of the die-casting machine according to this embodiment. In FIG. 1 and FIGS. 5-8 which will be described later, the configuration of a direct-acting block which will be described below is partially omitted for the sake of advantage to show the state of links (arms) of a crank mechanism which will be described below.

In FIG. 1, the reference numeral 1 represents a fixed die plate. A fixed mold 2 is attached to the fixed die plate 1. A retention plate 3 is disposed at a predetermined distance from the fixed die plate 1 so as to be opposed thereto. A plurality of connecting shafts 4 are laid between the fixed die plate 1 and the retention plate 3. The connecting shafts 4 are inserted into a direct-acting block 5. The direct-acting block 5 is guided by the connecting shafts 4 so as to be able to move forward and backward between the fixed die plate 1 and the retention plate 3. A first electric servo motor 6 for driving an injection plunger (or for driving an injection member) is mounted on the retention plate 3. A driving pulley 7 is fixed to an output shaft of the first electric servo motor 6. A ball screw mechanism 8 converts the rotation of the first electric servo motor 6 into a linear motion. The ball screw mechanism 8 has a screw shaft 9 and a nut 10. The screw shaft 9 is rotatably retained on the retention plate 3. The nut 10 is screwed down to the screw shaft 9 while an end portion of the nut 10 is fixed to the direct-acting block 5. A driven pulley 11 is fixed to an end portion of the screw shaft 9. The rotation of the first electric servo motor 6 is transferred to the driven pulley 11 through the driving pulley 7 and a not-shown timing belt.

A second electric servomotor 12 for driving the injection plunger (or for driving the injection member) is mounted on the direct-acting block 5. A driving pulley 13 is fixed to an output shaft of the second electric servo motor 12. A fly-wheel 14 having a large diameter and a high mass also serves as a driven pulley to which the rotation of the second electric servo motor 12 is transferred through the driving pulley 13 and a timing belt 15. A crank mechanism 16 is driven and rotated at its input terminal by the rotation of the fly-wheel 14 so as to make a crank motion. A plunger driver 17 is fixed to an output terminal of the crank mechanism 16 so as to be driven linearly (or driven to move forward and backward) by the crank mechanism 16. An injection sleeve 18 has an end portion fixed to the fixed mold 2 and an inner portion communicating with a cavity 23. A supply port 19 is provided in the injection sleeve 18. An injection plunger 20 has an end portion fixed to the plunger driver 17 so as to be able to move linearly (or move forward and backward) in the injection sleeve 18.

A movable die plate 21 is driven by a not-shown mold opening/closing electric driving source and a not-shown mold opening/closing mechanism, so as to move forward and backward relatively to the fixed die plate 1. A movable mold 22 is attached to the movable die-plate 21. A cavity (space for forming a die-cast product) 23 is formed by the two molds 2 and 22 when the molds 2 and 22 are clamped. A mold runner portion 24 guides molten metal into the cavity 23. A gate 25 allows the mold runner portion 24 and the cavity 23 to communicate with each other. The reference numeral 26 represents metal melt (molten metal).

In this embodiment, the rotation of the first electric servo motor 6 is transferred to the screw shaft 9 of the ball screw mechanism 8 through the driving pulley 7, the not-shown timing belt and the driven pulley 11. Due to the transferred rotation, the nut 10 of the ball screw mechanism 8 screwed down to the screw shaft 9 is driven linearly along the screw shaft 9. The injection plunger 20 together with the direct-acting block 5 and constituent parts mounted thereon are driven linearly integrally with the nut 10. On the other hand, the rotation of the second electric servo motor 12 is transferred to the input terminal of the crank mechanism 16 through the driving pulley 13, the timing belt 15 and the fly-wheel 14. Due to the transferred rotation, the crank mechanism 16 makes a crank motion so that the output terminal of the crank mechanism 16 moves linearly. The plunger driver 17 and the injection plunger 20 are driven linearly integrally with the output terminal of the crank mechanism 16. Thus, in this embodiment, the ball screw mechanism 8 driven by the first electric servo motor 6 and the crank mechanism 16 driven by the second electric servo motor 12 are arranged in series in line with the injection plunger 20. The injection plunger 20 is driven linearly with cooperation of the first electric servo motor 6 and the second electric servo motor 12.

Figure 2:
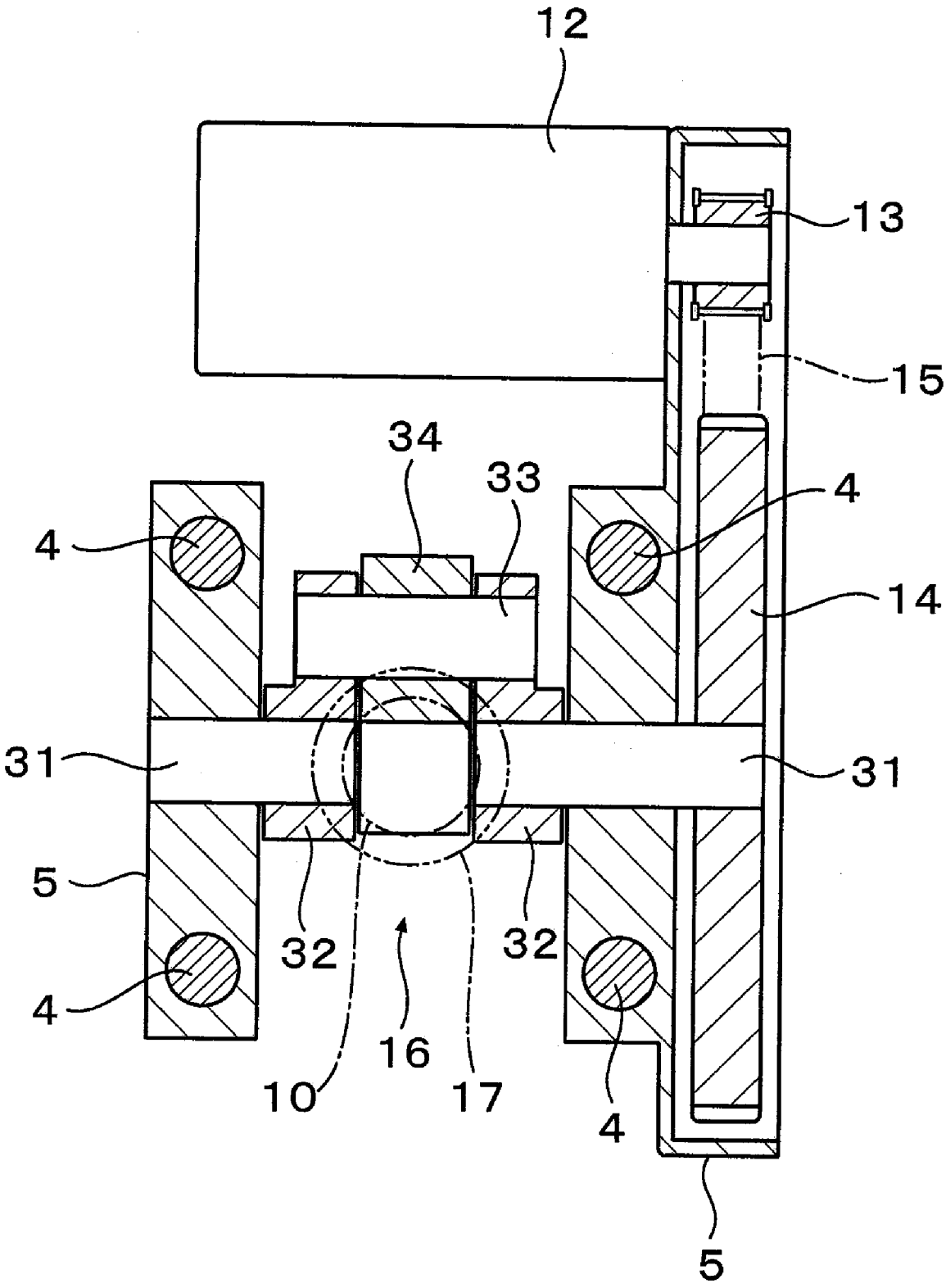
FIG. 2 is a simplified and partially cutaway main portion side view showing the configuration in and around a crank mechanism in the die-casting machine according to the embodiment.

FIG. 2 is a simplified and partially cutaway main portion side view showing the configuration on and around the crank mechanism in the die-casting machine according to this embodiment. In FIG. 2, the direct-acting block 5 is drawn to be parted to the right and the left. In fact, however, the direct-acting block 5 has a continuously integrated structure as a whole. In FIG. 2, constituent parts the same as the parts described previously are referenced correspondingly (the same thing can be applied to FIGS. 5-10 which will be described later).

In FIG. 2, a pair of first rotating shafts 31 are rotatably retained on the direct-acting block 5. The paired first rotating shafts 31 are disposed so that their centers of rotation are on one and the same line. The center of the fly-wheel 14 is fixed to an end portion of one of the first rotating shafts 31 which serves as a force input terminal of the crank mechanism 16. One ends of first links (first arms) 32 are fixed to the first rotating shaft 31 respectively. A connecting shaft 33 for connecting the other ends of the paired first links 32 are fixed to the other ends of the first links 32. One end of a second link (second arm) 34 is rotatably retained on an intermediate portion of the connecting shaft 33. The other end of the second link 34 is fixed to a second rotating shaft 35 (which serves as a force output terminal of the crank mechanism 16) rotatably retained on the plunger driver 17, as shown in FIG. 1. The crank mechanism 16 is constituted by the first rotating shafts 31, the first links 32, the connecting shaft 33, the second link 34 and the second rotating shaft 35. The reason why the paired first links 32 are provided as described above is to retain and link the one end side of the second link 34 on the other end side of the paired first links 32 so as to improve the balance and the mechanical strength in the mechanism which bears the force. The two first rotating shafts 31 are independent of each other because the extension of the center of rotation of each first rotating shaft 31 must overlap the rotating trajectory of the second link 34.

The nut 10 shown by the two-dot chain line in FIG. 2 is fixed to a left/right connecting portion of a not-shown rear portion (right in FIG. 1) of the direct-acting block 5. The left/right connecting portion of the rear portion connects the left and right sides of the direct-acting block 5 illustrated independently of each other in FIG. 2. The left/right connecting portion of the rear portion is shaped not to interfere with the screw shaft 9. The plunger driver 17 shown by the two-dot chain line in FIG. 2 is retained movably linearly (or movably forward and backward) on a left/right connecting portion of a not-shown front portion (left in FIG. 1) of the direct-acting block 5. The left/right connecting portion of the front portion connects the left and right sides of the direct-acting block 5 illustrated independently of each other in FIG. 2.

The rotation of the second electric servo motor 12 is reduced by a reduced rotation transfer system constituted by the driving pulley 13, the timing belt 15 and the fly-wheel 14. The reduced rotation is transferred to one first rotating shaft 31. One first link 32 whose one end is fixed to the one first rotating shaft 31 is driven to rotate around the one end. Thus, the second link 34 makes a cooperative follow-up operation (in which the second link 34 rotates with a predetermined trajectory following the rotation of the one first link 32 so as to makes a linear motion on the other end side of the second link 34 which is pivotally connected to the plunger driver 17) following the rotation of the one first link 32. At the same time, the other first link 32 following the rotation of the one first link 32 rotates around its one end together with the other first rotating shaft 31. Due to such an operation, the plunger driver 17 is driven linearly so that the injection plunger 20 is driven linearly.

Figure 3:
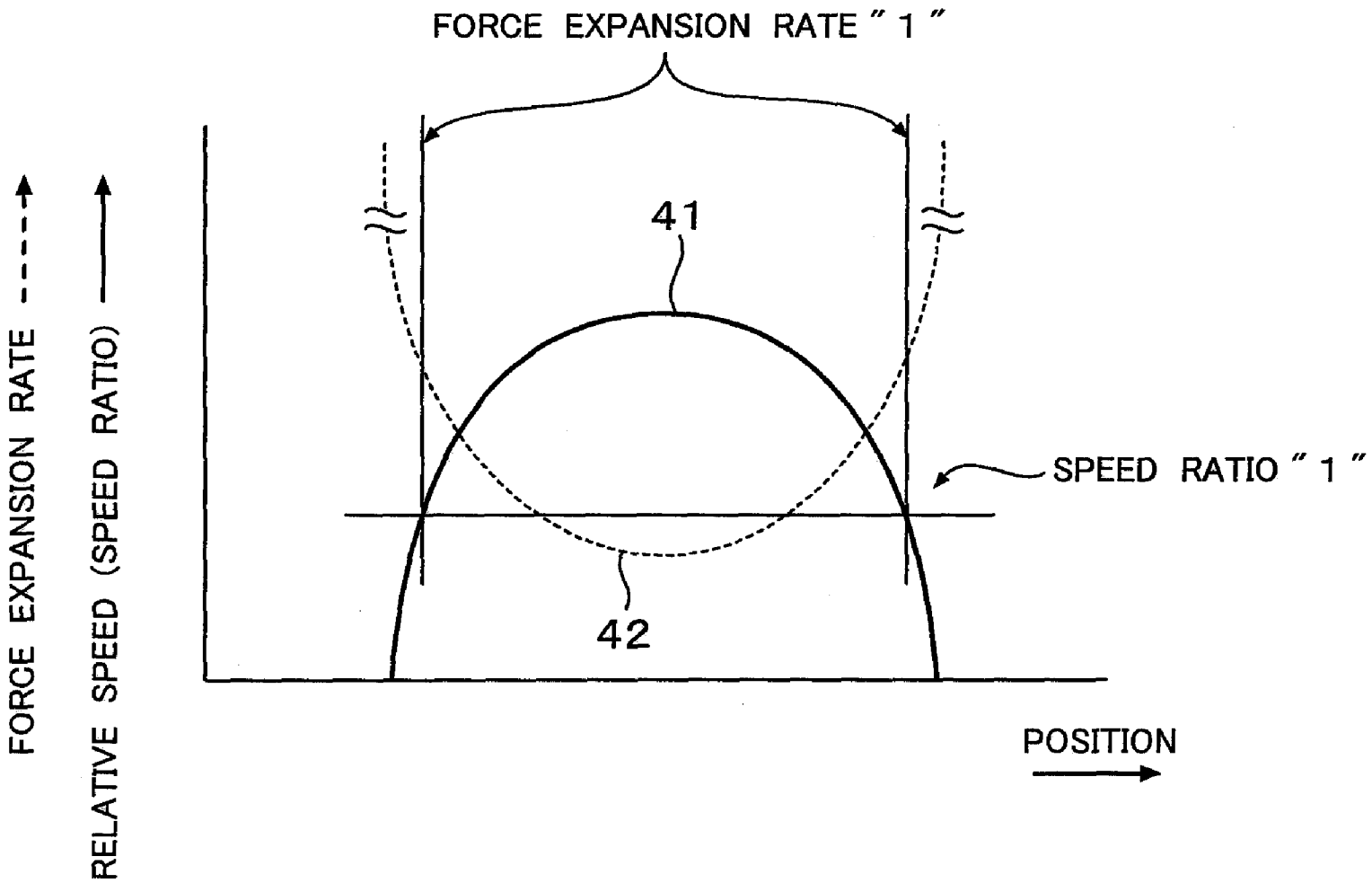
FIG. 3 is a very schematic characteristic graph showing a change of a speed and a change of an expansion rate of force in a force output terminal of a crank mechanism when a force input terminal of the crank mechanism is rotated at a constant speed.
Figure 5:
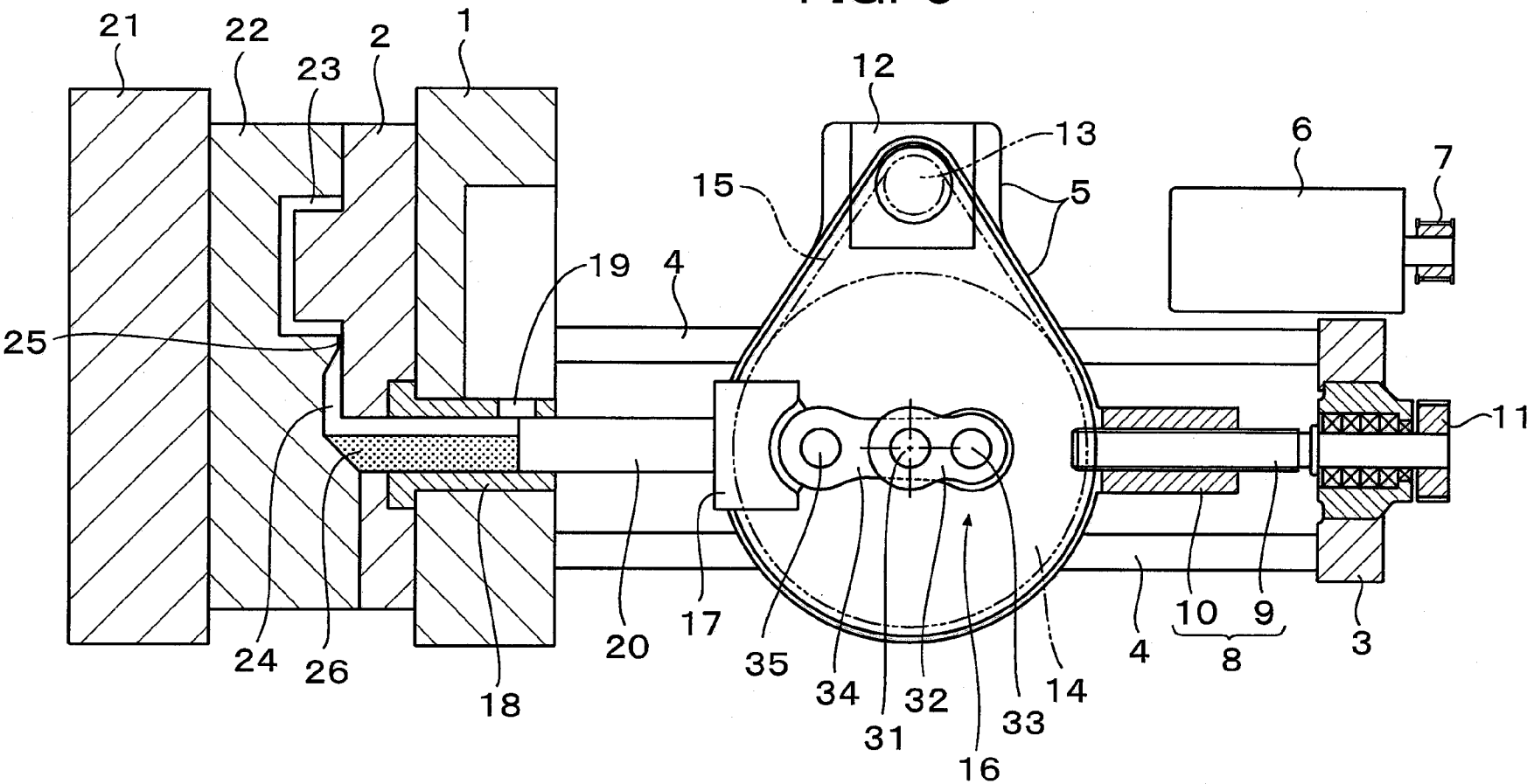
FIG. 5 is a simplified and partially cutaway explanatory view showing the main portion configuration of the die-casting machine according to the embodiment, in which the die-casting machine is engaging in the injection/filling step.

FIG. 3 is a very schematic characteristic graph showing a change of a speed and a change of an expansion rate of force in the force output terminal (second rotating shaft 35) of the crank mechanism 16 when the force input terminal (first rotating shaft 31) of the crank mechanism 16 is rotated at a constant speed. In FIG. 3, the abscissa designates the position of the force output terminal of the crank mechanism 16, and the ordinate designates the speed ratio (relative speed) and the expansion rate of force. The reference numeral 41 represents a characteristic curve of the speed ratio, and 42 represents a characteristic curve of the expansion rate of force. FIG. 3 shows the characteristics between the state where the first link 32 of the crank mechanism 16 lies as shown in FIG. 5 which will be described later (or the state where the first link 32 is in the position of 0°) and the state where the first link 32 rotates by 180°. In this embodiment, the input terminal (first rotating shaft 31) and the first link 32 of the crank mechanism 16 are designed to be rotated between −30° and 90°. However, the case where they are rotated between 0° and 180° is shown for the advantage to description of the speed ratio characteristic and the force expansion rate of the crank mechanism 16.

As soon as the first link 32 begins to rotate in the position of 0°, the speed of the force output terminal of the crank mechanism 16 begins to increase from the speed ratio (relative speed) "0". After the speed ratio (relative speed) is beyond "1", the speed reaches a maximum speed when the first link 32 rotates by 90°. On and after reaching the maximum speed, the speed begins to decrease. After the speed ratio (relative speed) is below "1", the speed ratio (relative speed) reaches "0" when the first link 32 finishes rotating by 180°. On the other hand, as soon as the first link 32 begins to rotate in the position of 0°, the force expansion rate of the force output terminal of the crank mechanism 16 begins to decrease from infinity. After the expansion rate is below "1", the expansion rate reaches a minimum expansion rate. On and after reaching the minimum expansion rate, the expansion rate begins to increase. After the expansion rate is beyond "1", the force expansion rate reaches infinity when the first link 32 finishes rotating by 180°. The characteristic curves 41 and 42 in FIG. 3 show very schematic characteristics as described previously. The characteristic curves 41 and 42 can have desired operating characteristics according to how to design the crank mechanism 16.

In this embodiment, in consideration of the characteristic of the speed ratio and the characteristic of the force expansion rate of the crank mechanism 16 as described above, the crank mechanism 16 is designed so that the speed ratio is beyond "1" at timing when the head of the molten metal 26 reaches the gate 25. More preferably the crank mechanism 16 is designed so that the speed ratio is beyond "1.5" in the same timing. In addition, the crank mechanism 16 is designed so that the speed ratio reaches the maximum speed at timing when injecting/filling the molten metal 26 into the cavity 23 is completed. That is, of the operating range of the crank mechanism 16, a region having a higher speed ratio is used to inject/fill the molten metal 26 into the cavity 23 through the gate 25 at a higher speed. The reason why the crank mechanism 16 is designed in such a manner is that not to intensify pressure in the pressure intensifying step but to rise to a high injection speed in a short time is difficult only by the output of a small-size electric servo motor in a die-casting machine using the electric servo motor as a driving source for the injection plunger 20.

In this embodiment, the crank mechanism 16 is driven by the second electric servo motor 12 through the fly-wheel 14 having high inertia. Accordingly, at timing when the head of the molten metal 26 reaches the gate 25, the second electric servo motor 12 is designed to complete the operation of acceleration, that is, the fly-wheel 14 is designed to complete the operation of acceleration of rotation. In order to allow the fly-wheel 14 having high inertia to complete the acceleration of rotation at the timing when the head of the molten metal 26 reaches the gate 25, the force input terminal (or the first rotating shaft 31) and the first link 32 of the crank mechanism 16 are designed to begin to rotate at the rotation position of −30°.

Figure 4:
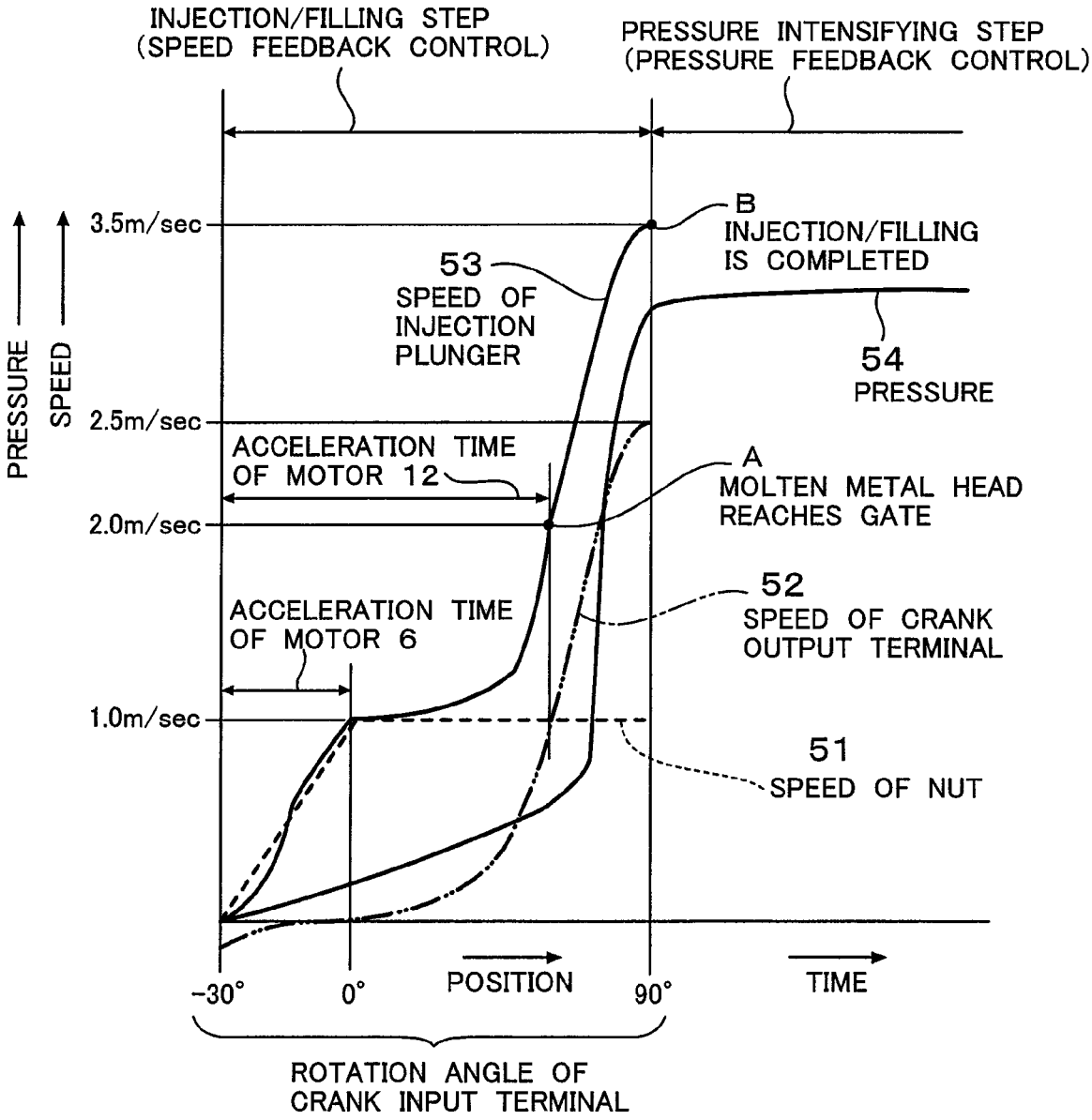
FIG. 4 is an explanatory chart chiefly showing the operating characteristic of an injection/filling step in the die-casting machine according to the embodiment.

Next, description will be made about the injection/filling operation of the die-casting machine according to this embodiment. FIG. 4 is a chart chiefly showing the operating characteristic of the injection/filling step in the die-casting machine according to this embodiment. In FIG. 4, the ordinate designates speed and pressure, and the abscissa designates a position in the injection/filling step and time in the pressure intensifying step.

In FIG. 4, the reference numeral 51 represents a speed (set speed) of the nut 10 driven by the first electric servo motor 6; 52, a speed (set speed) of the force output terminal of the crank mechanism 16 driven by the second electric servo motor 12; and 53, a speed (set speed) of the injection plunger 20 expressed by the sum of the speed 51 and the speed 52. In the injection/filling step, the first electric servo motor 6 and the second electric servo motor 12 are driven by speed feedback control along the position axis. The reference numeral 54 represents pressure (load pressure) applied to the molten metal 26 (or applied to the injection plunger 20).

FIG. 1 shows a state where the injection/filling step has not been started yet. In this state, the nut 10 is in a retired position, and the force input terminal (or the first rotating shaft 31) and the first link 32 of the crank mechanism 16 are in a rotated position of −30°. The injection plunger 20 is positioned in a set retired position. The molten metal 26 can be supplied into the injection sleeve 18 through the supply port 19 of the injection sleeve 18.

In the state shown in FIG. 1, a supply operation in which the molten metal 26 is supplied into the injection sleeve 18 through the supply port 19 is performed by a ladle of a not-shown supply device. As soon as the supply operation is completed, the first electric servo motor 6 and the second electric servo motor 12 begin to be driven to rotate in predetermined directions respectively. In an example of operation of this embodiment shown in FIG. 4, the first electric servo motor 6 is controlled to be accelerated till the forward speed of the nut 10 reaches 1.0 m/sec, while the second electric servomotor 12 is controlled to be accelerated till the forward speed of the force output terminal of the crank mechanism 16 reaches 1.0 m/sec. Thus the injection plunger 20 begins to move forward. In this embodiment, the force input terminal and the first link 32 of the crank mechanism 16 begin to rotate at the rotated position of −30°. Therefore, at an early stage of the rotation of the second electric servo motor 12 (or between the stage where the force input terminal of the crank mechanism 16 is in the rotated position of −30° and the stage where the force input terminal reaches the rotated position of 0°), the force output terminal of the crank mechanism 16 moves backward by about 7 mm. At this time, the nut 10 moves forward. After all, the injection plunger 20 moves forward.

FIG. 5 shows the state where the acceleration of the first electric servo motor 6 has been completed, and the force input terminal of the crank mechanism 16 has been rotated to reach the rotated position of 0°. In this state, the fly-wheel 14 has been rotated by 30° with reference to its stop position. Thus, the fly-wheel 14 has begun to have rotational inertia.

Figure 6:
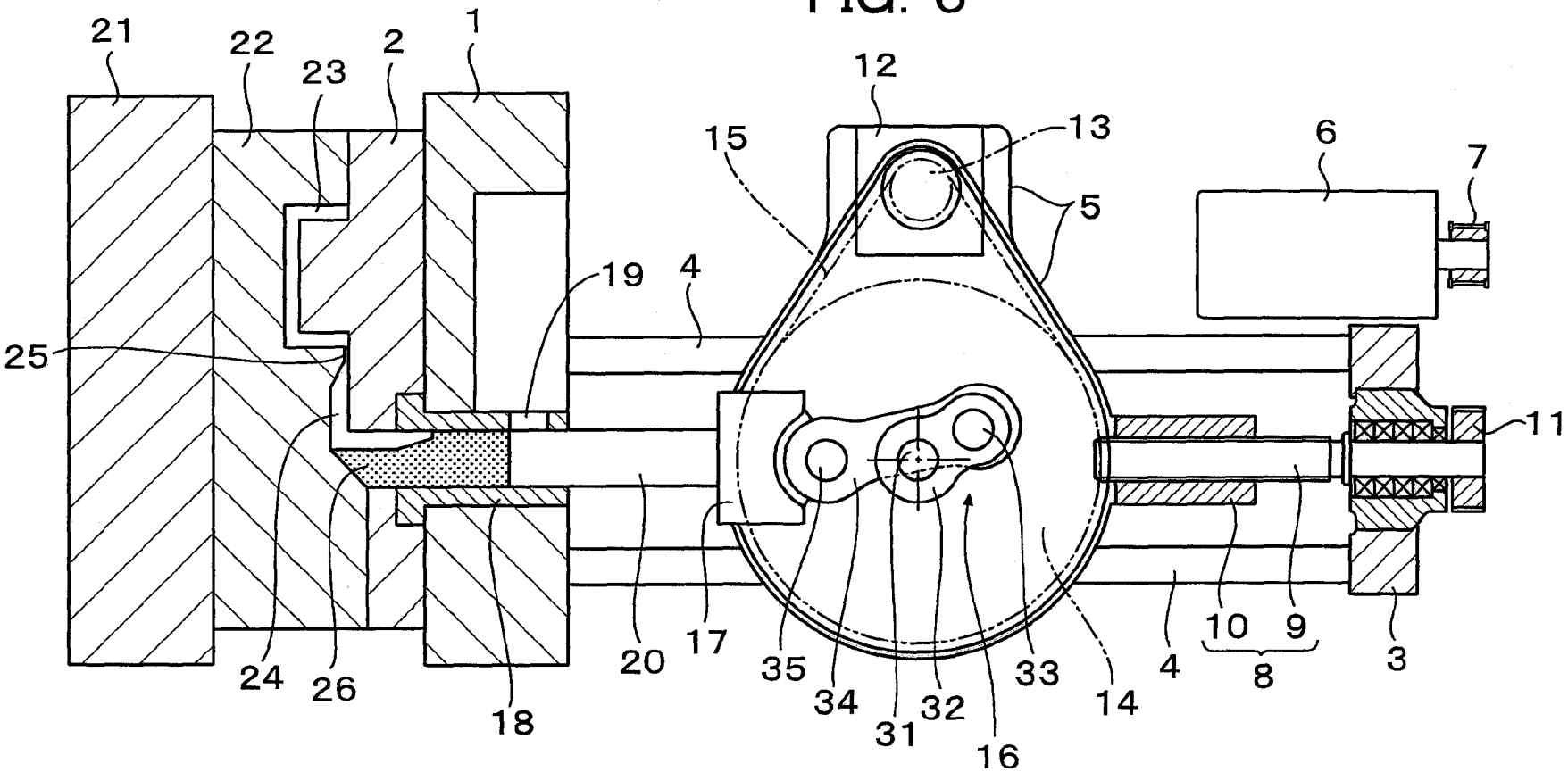
FIG. 6 is a simplified and partially cutaway explanatory view showing the main portion configuration of the die-casting machine according to the embodiment, in which the die-casting machine is engaging in the injection/filling step.
Figure 7:
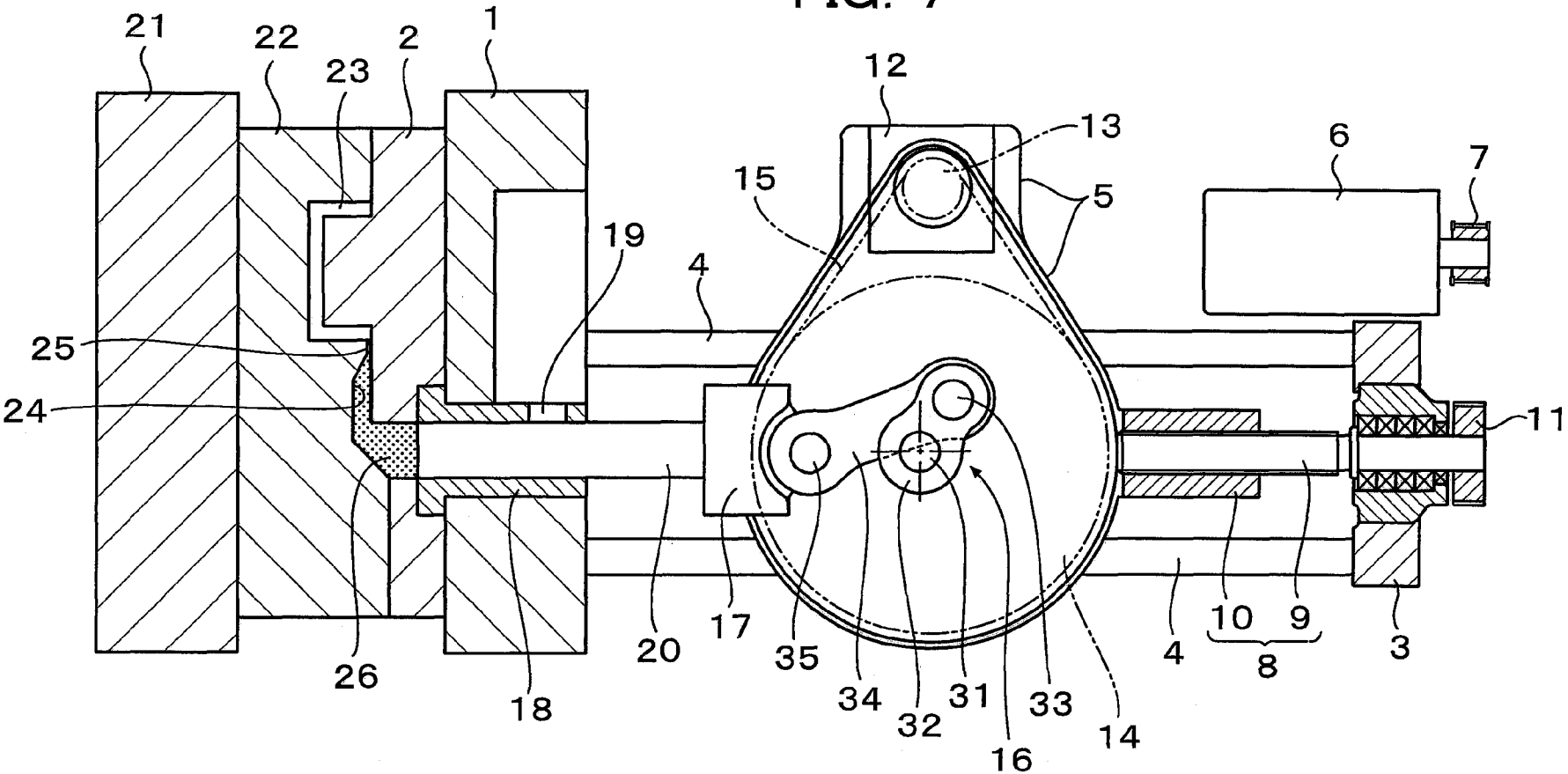
FIG. 7 is a simplified and partially cutaway explanatory view showing the main portion configuration of the die-casting machine according to the embodiment, in which the die-casting machine is engaging in the injection/filling step.

When the acceleration is completed, the first electric servo motor 6 is driven to rotate at a constant speed. The second electric servo motor 12 is accelerated till the forward speed of the force output terminal of the crank mechanism 16 reaches 1.0 m/sec. Thus, the injection plunger 20 in the state of FIG. 5 moves forward while increasing its forward speed (or being accelerated). As shown in FIG. 6, the injection plunger 20 closes the supply port 19 of the injection sleeve 18. After the state shown in FIG. 6, the head of the molten metal 26 pressed by the injection plunger 20 reaches the gate 25 as shown in FIG. 7. Degassing is performed during the course between the state of FIG. 6 and the state of FIG. 7. In this embodiment, the injection plunger 20 is continuously accelerated during the degassing. Therefore, degassing can be performed well in a short time (as will be described in detail later with reference to FIGS. 9A, 9B-1, 9B-2, 9C-1, 9C-2 and 9D).

Figure 11:
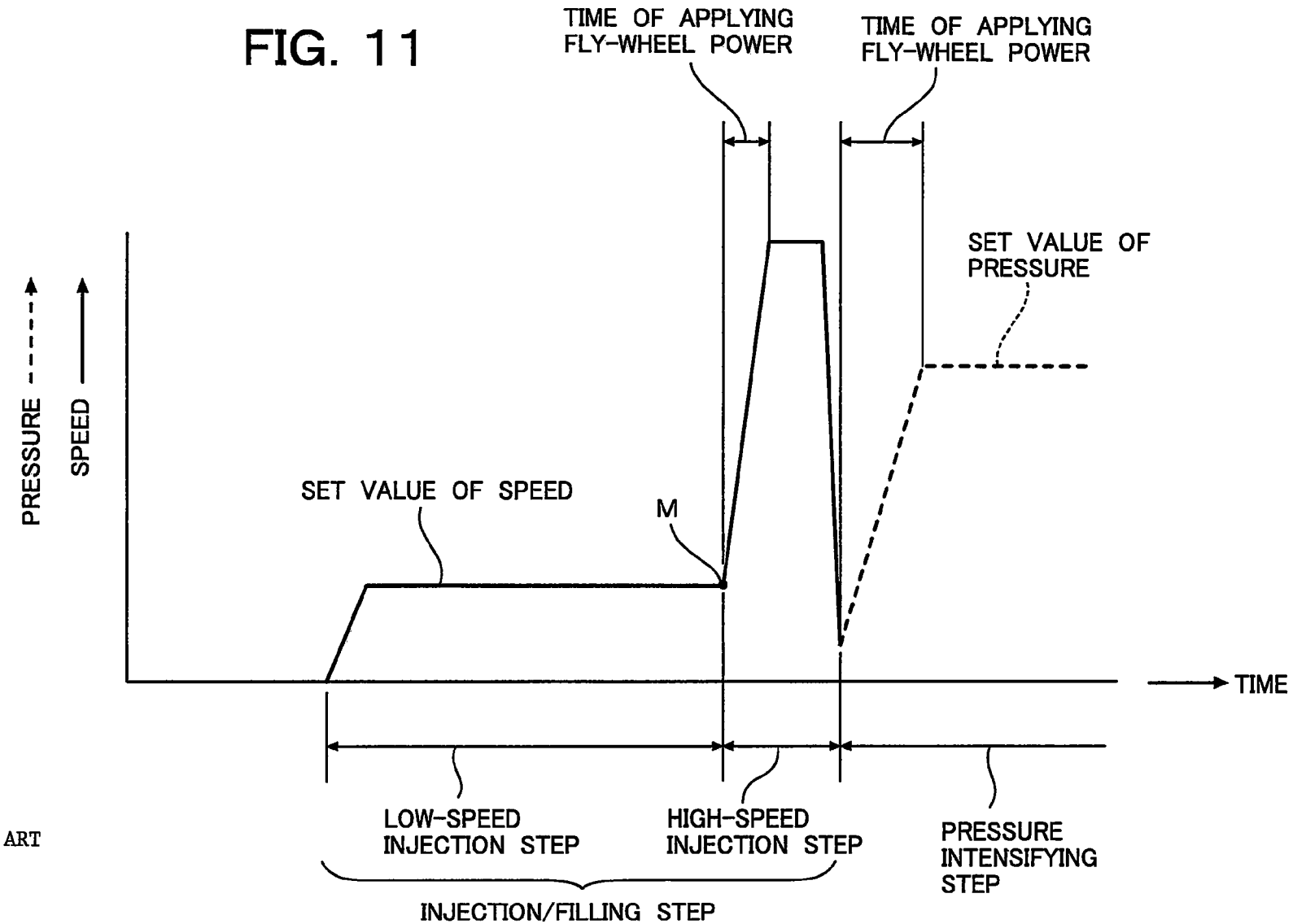
FIG. 11 is an explanatory chart showing the state of an injection/filling step and a pressure intensifying step in a background-art die-casting machine.

When the head of the molten metal 26 reaches the gate 25 as shown in FIG. 7, the acceleration of the second electric servo motor 12 is completed, and the acceleration of the fly-wheel 14 is completed. The state shown in FIG. 7 corresponds to the timing A in FIG. 4. In this time, the forward speed of the injection plunger 20 is 2.0 m/sec, which is much higher than the background-art value of about 0.7 m/sec or lower at the timing M or N shown in FIG. 11 or 12.

On and after the state where the head of the molten metal 26 reaches the gate 25 as shown in FIG. 7 (or the timing A in FIG. 4), the second electric servo motor 12 is also driven to rotate at a constant speed. However, on and after the timing A in FIG. 4, the speed ratio of the crank mechanism 16 is beyond "1" as described previously. Even if both the first electric servo motor 6 and the second electric servo motor 12 are driven to rotate at constant speeds on and after the timing A in FIG. 4, the injection plunger 20 can be continuously accelerated in conformity with the above-mentioned speed ratio characteristic of the crank mechanism 16.

Figure 8:
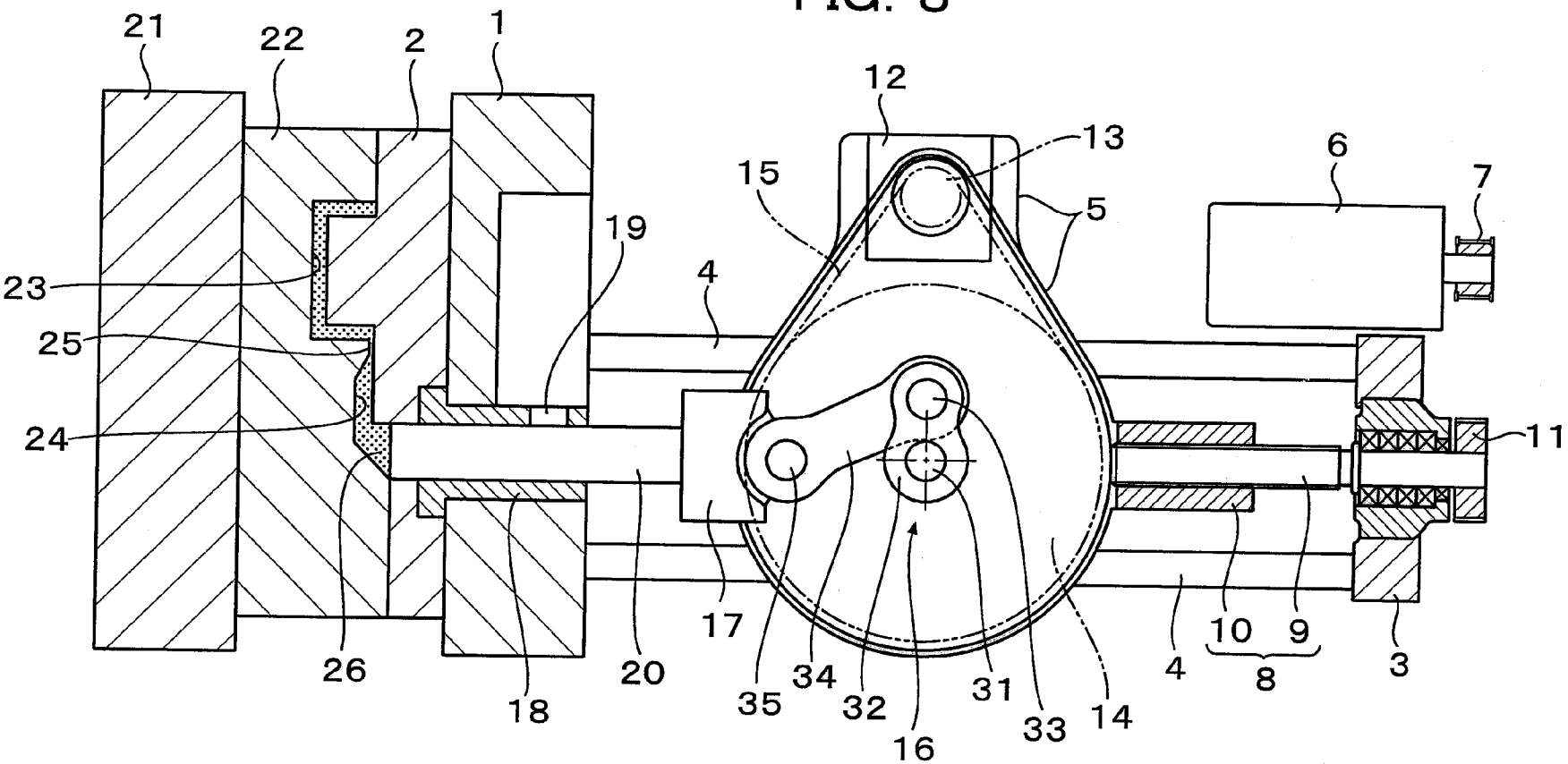
FIG. 8 is a simplified and partially cutaway explanatory view showing the main portion configuration of the die-casting machine according to the embodiment, in which the die-casting machine has completed the injection/filling step.

On and after the timing A in FIG. 4, the injection plunger 20 is accelerated in conformity with the speed ratio characteristic of the crank mechanism 16. Thus, the molten metal 26 is filled into the cavity 23 rapidly. As soon as the speed ratio characteristic of the crank mechanism 16 reaches the maximum speed, injection/filling (injection/filling step) is completed (the timing B in FIG. 4 is the timing when injection/filling is completed). When injection/filling is completed, the molten metal 26 spreads all over the cavity 23 as shown in FIG. 8.

In this embodiment, between the state where the force input terminal of the crank mechanism 16 is rotated to reach the rotated position of 0° (or the state shown in FIG. 5) and the state where injection/filling is completed (or the state shown in FIG. 8), the injection plunger 20 is controlled to be accelerated in a smooth speed characteristic curve which does not have a broken-line characteristic, as shown in FIG. 4. That is, the injection plunger 20 is controlled to be accelerated in a smooth speed characteristic curve which does not have a broken-line characteristic, even during the course between the stage where the molten metal 26 has not reached the gate 25 yet and the stage where the molten metal 26 begins to pass the gate 25. Accordingly in comparison with the background-art configuration where a broken-line speed characteristic curve is applied during the course between the state where the molten metal has not reached the gate yet and the state where the molten metal begins to pass the gate, the acceleration performance of the plunger 20 can be improved on a large scale when and after the molten metal 26 begins to pass the gate 25. It is therefore possible to shorten the time for the injection plunger 20 to reach the maximum speed (for example, 3.5 m/sec in this embodiment). It is also possible to make the acceleration behavior of the injection plunger 20 smooth and moderate. Further, the speed of the injection plunger 20 at the timing when the molten metal 26 reaches the gate 25 (or the timing A in FIG. 4) is set at 2.0 m/sec. In comparison with the background art, the interval between the time when the molten metal 26 begins to pass the gate 25 and the time when the injection plunger 20 reaches the maximum speed can be further shortened. Thus, in spite of the configuration where electric servo motors are used as driving sources for injection/filling, the injection/filling operation (behavior) of the molten metal 26 which will be cooled and solidified in a shorter time than synthetic resin can be controlled suitably. It is therefore possible to make a great contribution to casting a good product.

Moreover, in this embodiment, the ball screw mechanism 8 driven by the first electric servo motor 6 and the crank mechanism 16 driven by the second electric servo motor 12 are arranged in series in line with the injection plunger 20 so that the injection plunger 20 can be driven to move forward with cooperation of the first electric servo motor 6 and the second electric servo motor 12. Accordingly, the total sum of speeds obtained by the two electric servo motors 6 and 12 makes it easy to allow the injection plunger 20 to move forward at a high speed. Thus, the interval between the start of the injection/filling step and the timing A in FIG. 4 can be shortened, and the interval between the timing A in FIG. 4 and the timing B in FIG. 4 can be shortened. It is therefore possible to make a great contribution to casting a good product. This can be attained by the two small-sized electric servo motors 6 and 12. The cost can be reduced in comparison with a configuration using a high-power and expensive (more expensive than the two small-sized electric servo motors) electric servo motor.

Further, the speed ratio characteristic of the crank mechanism 16 driven by the second electric servo motor 12 is used effectively. That is, the operation between the stage where the molten metal 26 begins to be injected/filled into the cavity 23 and the stage where the injection/filling is completed is performed by a high speed ratio portion of the operating range of the crank mechanism 16. It is therefore possible to further shorten the interval between the timing A in FIG. 4 and the timing B in FIG. 4. Also from this point, it is possible to make a great contribution to casting a good product.

In this embodiment, the speed of the injection plunger 20 at the timing when the molten metal 26 reaches the gate 25 is set at 2.0 m/sec. However, the speed of the injection plunger 20 at the timing when the molten metal 26 reaches the gate 25 may be set desirably. In order to further shorten the interval between the time when the molten metal 26 begins to pass the gate 25 and the time when the injection plunger 20 reaches the maximum speed, it is preferable that the speed of the injection plunger 20 at the timing when the molten metal 26 reaches the gate 25 is set to be not lower than 1.5 m/sec as described above.

When the injection/filling step is completed, the pressure intensifying step is performed. The control of the first electric servo motor 6 and the second electric servo motor 12 is switched from speed feedback control along the position axis to pressure feedback control along the time axis. In this embodiment, at the beginning of the pressure intensifying step after the injection/filling step is completed, high rotational inertia remains in the fly-wheel 14. Due to large torque caused by the rotational inertia of the fly-wheel 14, a large forward inertia force is applied to the injection plunger 20. As a result, the injection plunger 20 stops suddenly due to reaction from the metal 26 which has begun to solidify, while a high pressure is applied to the injection plunger 20 rapidly. In the pressure intensifying step in this embodiment, for example, the second electric servo motor 12 is controlled to always output constant pressure (constant torque). At the same time, a value detected by a pressure sensor for detecting the pressure applied to the injection plunger 20 is monitored. When the measured pressure is out of set pressure, the first electric servo motor 6 is controlled to make the measured pressure follow the set pressure.

In this embodiment, as described above, high intensified pressure can be obtained even in the beginning of the pressure intensifying step due to the high rotational inertia of the fly-wheel 14. Thus the transient response delay at the rising time of pressure control of the two electric servo motors 6 and 12 can be covered. In addition, high intensified pressure can be obtained easily by the total sum of torques of the two electric servo motors 6 and 12.

Figure 9A:
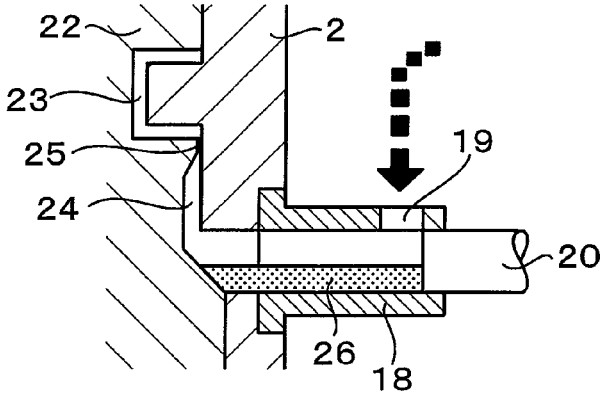
Figure 9A:
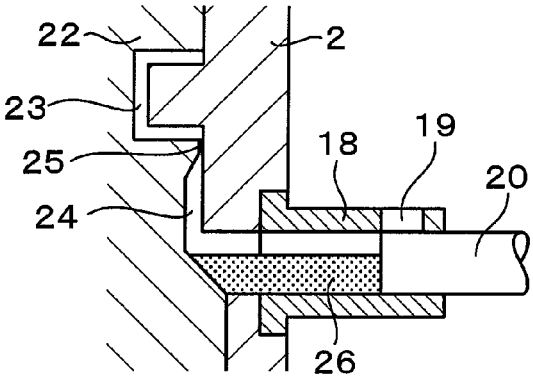
Figure 9A:
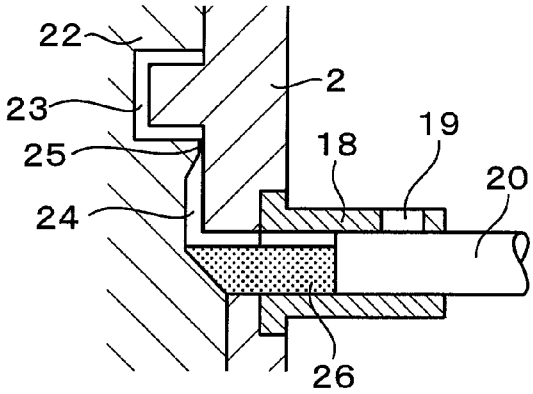
Figure 9A:
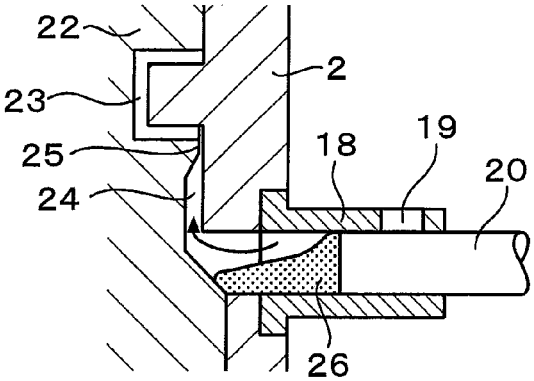
Figure 9A:
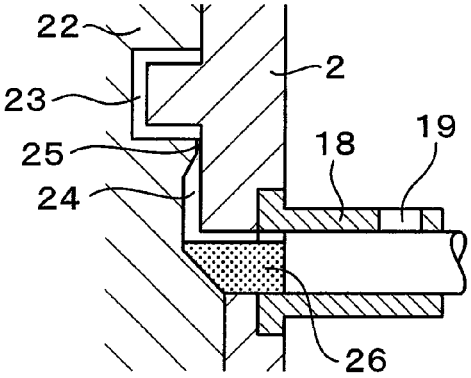
Figure 9D:
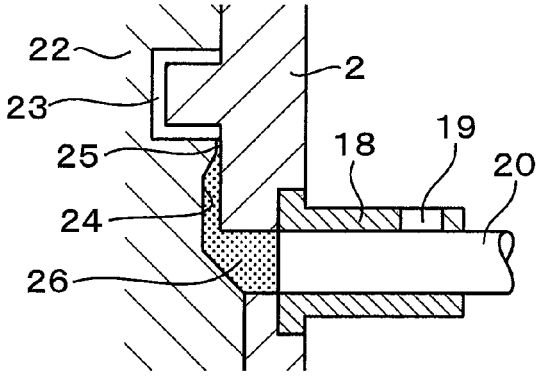

FIGS. 9A, 9B-1, 9B-2, 9C-1, 9C-2 and 9D are views showing degassing behavior according to this embodiment in comparison with degassing behavior in the background art. In this embodiment, on completing the supply operation in FIG. 9A, degassing in the first stage of the injection/filling step is started and performed during the continuous acceleration of the injection plunger 20. The forward speed of the injection plunger 20 when degassing is completed as shown in FIG. 9D is 2.0 m/sec. That is, the acceleration curve of the injection plunger 20 during the degassing in the first stage of the injection/filling step is sharper than that during degassing in the first stage (or the low-speed injection step in FIG. 12) of the background-art injection/filling step shown in FIG. 12. In this embodiment, when the injection plunger 20 begins to be moved forward and accelerated rapidly so that the forward speed of the injection plunger 20 increases as shown in FIG. 9B-1, the molten metal 26 makes its fluid level slope down to the illustrated left due to the accelerated injection plunger 20 as shown in FIG. 9C-1. Thus, gas in the injection sleeve 18 suffers a forward force so as to move toward the cavity 23 as shown by the arrow in FIG. 9C-1. Via the cavity 23, the gas enters not-shown very small degassing grooves of the mold, and is discharged into the mold rapidly. Thus, even if the time of degassing in the first stage of the injection/filling step (or the interval between the time when the injection/filling step starts and the time when the head of the molten metal 26 reaches the gate 25) is shortened, it is possible to perform degassing reliably without any problem.

Figure 12:
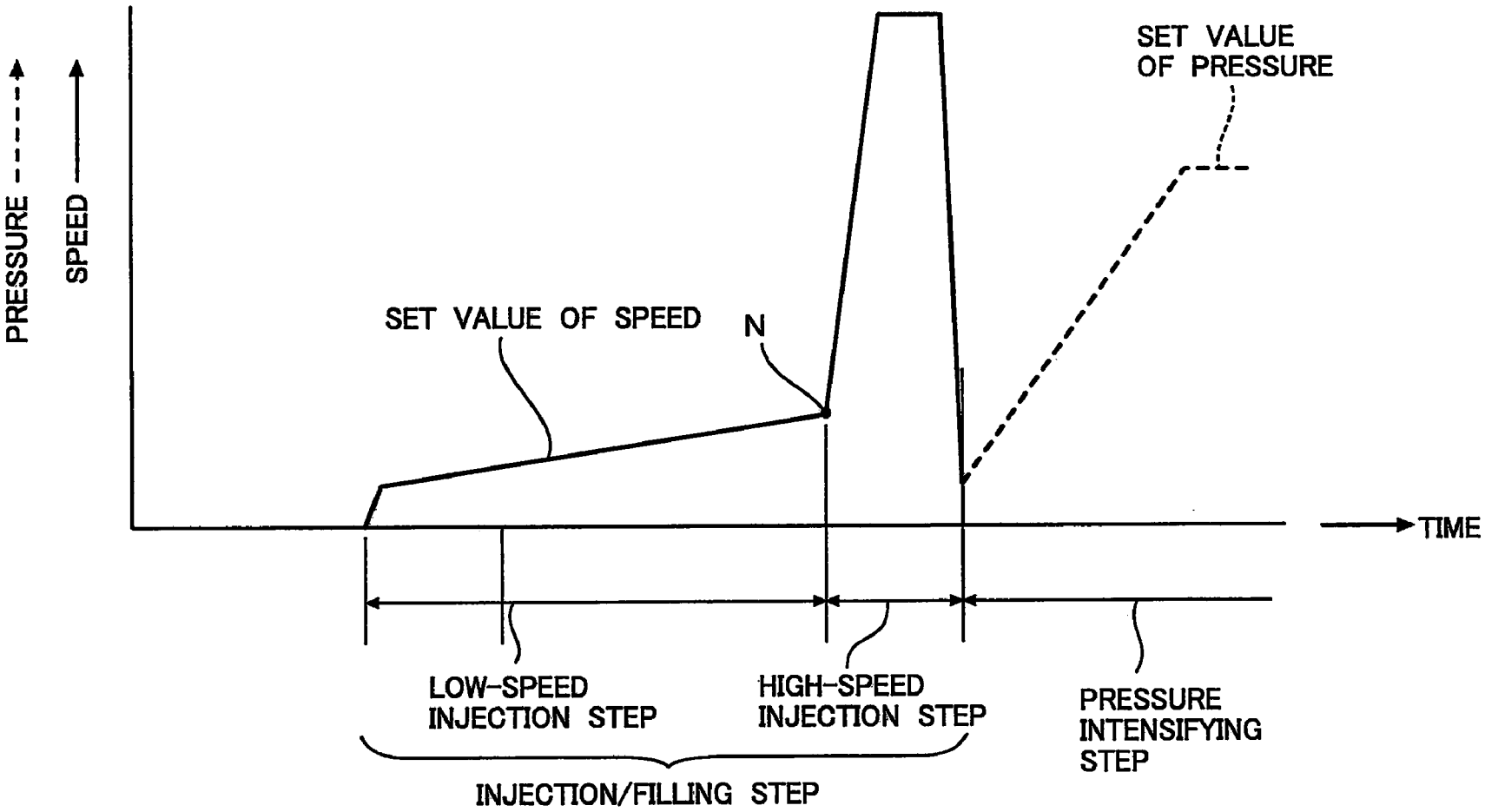
FIG. 12 is an explanatory chart showing the state of an injection/filling step and a pressure intensifying step in a background-art die-casting machine.

On the other hand, degassing in the first stage (or the low-speed injection step in FIG. 12) of the background-art injection/filling step shown in FIG. 12, the injection plunger 20 is indeed accelerated gradually, but the acceleration is extremely gentle. That leads to the behavior of the molten metal 26 allowing its horizontal fluid level to rise gradually as shown in FIGS. 9B-2 and 9C-2. Thus, degassing is performed so gently that a given interval is required between the time when the injection/filling step starts and the time when the head of the molten metal 26 reaches the gate 25.

In this embodiment, the acceleration of the first electric servo motor 6 and the second electric servomotor 12 is controlled by constant acceleration control. However, the acceleration of the first electric servo motor 6 and/or the second electric servo motor 12 may be controlled by continuous acceleration control in which the acceleration increases exponentially. By such continuous acceleration control, the behavior of the molten metal 26 as shown in FIG. 9C-1 can be expected to be conspicuous.

Figure 10:
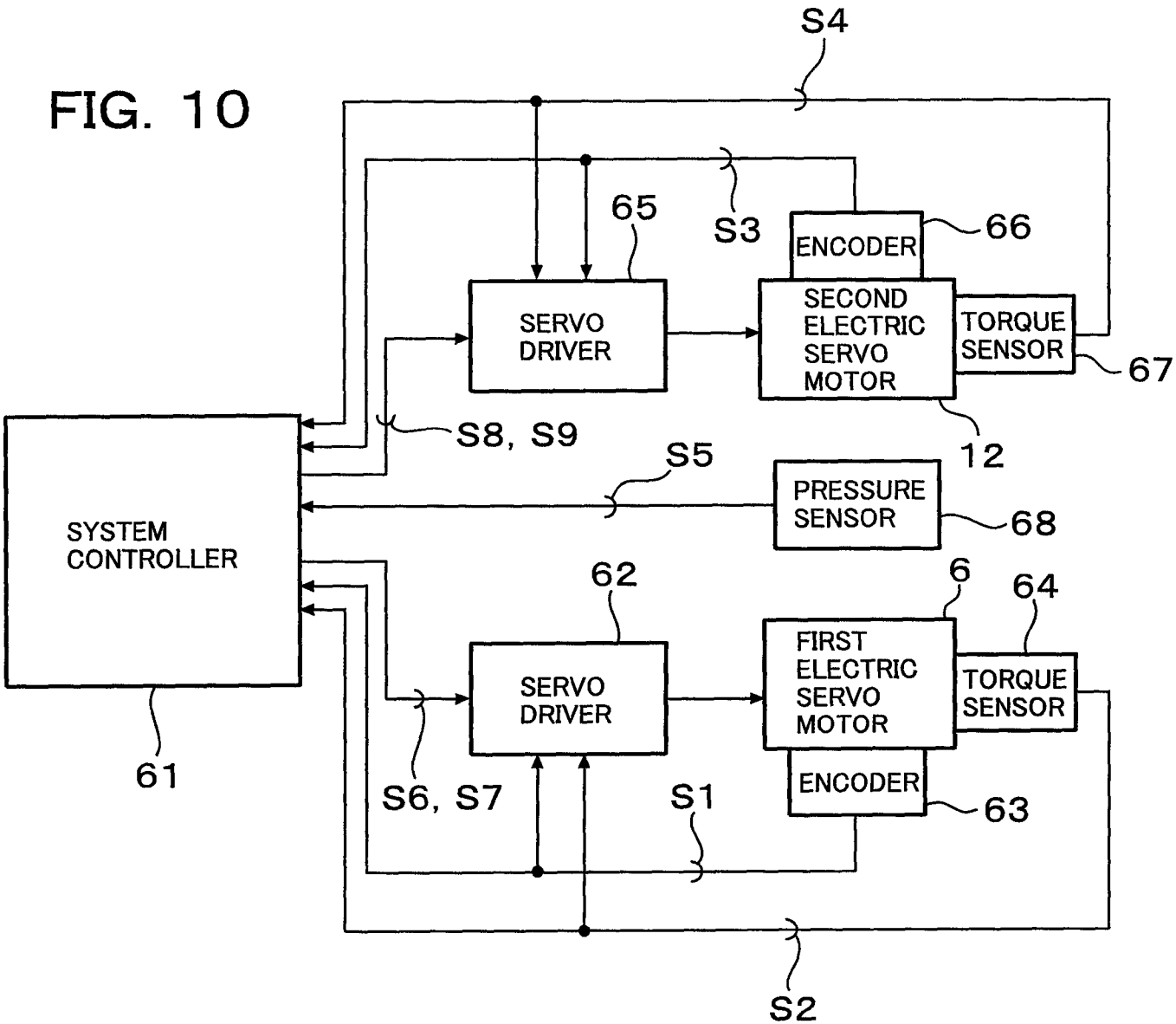
FIG. 10 is a block diagram showing the main portion configuration of control systems in the die-casting machine according to the embodiment.

FIG. 10 is a block diagram showing the main portion configuration of control systems in the die-casting machine according to this embodiment. FIG. 10 shows only the configuration engaging in controlling the first electric servo motor 6 and the second electric servo motor 12.

In FIG. 10, a system controller 61 controls the machine (die-casting machine) as a whole. The system controller 61 controls various control systems of the machine based on various application programs made up in advance and introduced into a work area, various operating condition data, measuring information from various sensors (position sensors, pressure sensors, sensors for confirming safe conditions, etc.) disposed in portions of the machine, status confirming information from various control systems of the machine, timing information, etc. The system controller 61 is provided with a not-shown injection/pressure intensifying control condition setting storage portion for the first electric servo motor 6 and a not-shown injection/pressure intensifying control condition setting storage portion for the second electric servo motor 12 in order to control the injection/filling step and the pressure intensifying step.

A servo driver 62 drives and controls the first electric servo motor 6 in accordance with a command from the system controller 61. An encoder 63 is additionally provided in the first electric servo motor 6. A detection output S1 of the encoder 63 is supplied to the system controller 61 and the servo driver 62. A torque sensor 64 is additionally provided in the first electric servo motor 6. A detection output S2 of the torque sensor 64 is supplied to the system controller 61 and the servo driver 62. A servo driver 65 drives and controls the second electric servo motor 12 in accordance with a command from the system controller 61. An encoder 66 is additionally provided in the second electric servo motor 12. A detection output S3 of the encoder 66 is supplied to the system controller 61 and the servo driver 65. A torque sensor 67 is additionally provided in the second electric servo motor 12. A detection output S4 of the torque sensor 67 is supplied to the system controller 61 and the servo driver 65. A pressure sensor 68 detects pressure (load) applied to the injection plunger 20. A detection output S5 of the pressure sensor 68 is supplied to the system controller 61.

In the injection/filling step, the system controller 61 refers to the contents of settings in the not-shown injection/pressure intensifying control condition setting storage portion for the first electric servo motor 6, and recognizes the current speed of the nut 10 based on the detection output S1 of the encoder 63. The system controller 61 gives a command S6 to the servo driver 62 so as to allow the speed of the nut 10 to follow its set value. In this manner, the first electric servo motor 6 is driven by speed feedback control along the position axis. In addition, the system controller 61 refers to the contents of settings in the not-shown injection/pressure intensifying control condition setting storage portion for the second electric servo motor 12, and recognizes the current speed of the force output terminal of the crank mechanism 16 based on the detection output S3 of the encoder 66. The system controller 61 gives a command S8 to the servo driver 65 so as to allow the speed of the force output terminal of the crank mechanism 16 to follow its set value. In this manner, the second electric servo motor 12 is driven by speed feedback control along the position axis.

In the pressure intensifying step, the system controller 61 refers to the contents of settings in the not-shown injection/pressure intensifying control condition setting storage portion for the second electric servo motor 12, and recognizes the current output torque (that is, output pressure) of the second electric servo motor 12 based on the detection output S4 of the torque sensor 67. The system controller 61 gives a command S9 to the servo driver 65 so as to allow the output torque (output pressure) of the second electric servo motor 12 to take a constant value. In this manner, the second electric servo motor 12 is driven by pressure feedback control along the time axis. In addition, the system controller 61 refers to the contents of settings in the not-shown injection/pressure intensifying control condition setting storage portion for the first electric servo motor 6, and recognizes the current output torque (that is, output pressure) of the first electric servo motor 6 based on the detection output S2 of the torque sensor 64. The system controller 61 also recognizes the current pressure applied to the injection plunger 20 based on the detection output S5 of the pressure sensor 68. The system controller 61 gives a command S7 to the servo driver 62 so as to allow the output torque of the first electric servo motor 6 to follow an expression of a set value. In this manner, the first electric servo motor 6 is driven by speed feedback control along the time axis.

What is claimed is:

1. A control method of a die-casting machine for injecting/filling molten metal into a cavity of a mold through an injection sleeve, the control method comprising the steps of:

transferring a driving force of an electric servo motor to an injection member, by which a molten metal in an injection sleeve is injected into the cavity, through a fly-wheel and a crank mechanism, in which a force input terminal thereof is connected to the fly-wheel, and transferring the driving force of the servo motor to the injection member through the fly-wheel and the crank mechanism during a course between a stage where the molten metal has not vet reached a gate of the mold and a stage where the molten metal begins to pass the gate of the mold so as to accelerate the speed of the injection member in a smooth speed characteristic curve, which does not have a broken-line characteristic.

2. A control method of a die-casting machine according to claim 1, wherein the electric servo motor is used as a driving source for injecting/filling the molten metal into the cavity of the mold through the injection sleeve.

3. A control method of a die-casting machine according to claim 2, wherein the speed of the injection member at timing when the molten metal reaches the gate of the mold is made not lower than 1.5 m/sec.

4. A control method of a die-casting machine according to claim 2, wherein the injection member is moved forward and backward by use of at least the crank mechanism driven by the electric servo motor, so that accelerating the electric servo motor is completed before the molten metal reaches the gate of the mold, and the injection member is accelerated in conformity with a speed ratio characteristic of the crank mechanism after the molten metal reaches the gate of the mold.

5. A control method of a die-casting machine including an injection plunger moving forward and backward in an injection sleeve, a first electric servo motor and a second electric servo motor as driving sources for the injection plunger, a ball screw mechanism for converting a rotational force of the first electric servo motor into a linear motion to thereby drive the injection plunger linearly, and a crank mechanism for converting a rotational force of the second electric servo motor into a linear motion to thereby drive the injection plunger linearly, the injection plunger being driven linearly with cooperation of the first and second electric servo motors, the control method comprising the step of:

controlling a speed of the injection plunger by use of a speed ratio characteristic of the crank mechanism when the molten metal in the injection sleeve is injected/filled into a cavity of a mold, so as to accelerate the speed of the injection plunger in a smooth speed characteristic curve, which does not have a broken-line characteristic, during a course between a stage where the molten metal has not reached a gate of the mold yet and a stage where the molten metal begins to pass the gate of the mold.

6. A control method of a die-casting machine according to claim 5, wherein the speed of the injection plunger at timing when the molten metal reaches the gate of the mold is made not lower than 1.5 m/sec.

7. A control method of a die-casting machine according to claim 5, wherein:

a force input terminal of the crank mechanism is designed to be driven to rotate through a fly-wheel which is driven to rotate by the second electric servo motor; and controlling acceleration of the second electric servo motor is completed at timing when the molten meal reaches the gate of the mold.

8. A control method of a die-casting machine according to claim 7, wherein the injection plunger is accelerated in conformity with the speed ratio characteristic of the crank mechanism after the molten metal reaches the gate of the mold.

9. A control method of a die-casting machine according to claim 7, wherein at least a rotational inertial force of the fly-wheel is used for intensifying pressure at an early stage of a pressure intensifying step.

* * * * *